United States Patent [19]

Yoder

[11] Patent Number: 4,502,665

[45] Date of Patent: Mar. 5, 1985

[54] APPARATUS FOR MOVING A CYLINDRICAL OBJECT

[76] Inventor: Lloyd S. Yoder, 9682 Keller Rd., Clarence Center, N.Y. 14032

[21] Appl. No.: 644,662

[22] Filed: Aug. 27, 1984

Related U.S. Application Data

[63] Continuation of Ser. No. 380,137, May 20, 1982, abandoned.

[51] Int. Cl.[3] ..... E21B 19/00

[52] U.S. Cl. ..... 254/29 R

[58] Field of Search ..... 254/29 R, 30, 31

[56] References Cited

U.S. PATENT DOCUMENTS

| | | | |
|---|---|---|---|
| 1,427,699 | 8/1922 | Richter | 254/29 R |
| 1,698,498 | 1/1929 | Harding | 254/29 R |
| 2,056,489 | 10/1936 | Scott et al. | 254/29 R |
| 2,612,343 | 9/1952 | Fraizer et al. | 254/29 R |
| 2,882,011 | 4/1959 | Ripstein | 254/29 R |
| 2,950,085 | 8/1960 | Lizzardo | 254/29 R |
| 3,645,502 | 2/1972 | Stromp, Jr. | 254/29 R |
| 3,945,608 | 3/1976 | Somerville et al. | 254/29 R |
| 3,966,169 | 6/1976 | Schosek | 254/29 R |
| 3,988,003 | 10/1976 | Schosek | 254/29 R |
| 3,988,004 | 10/1976 | Schosek | 254/29 R |
| 4,000,879 | 1/1977 | Martin et al. | 254/29 R |
| 4,247,081 | 1/1981 | Schosek | 254/29 R |
| 4,251,057 | 2/1981 | Schosek | 254/29 R |
| 4,251,058 | 2/1981 | Schosek | 254/29 R |

*Primary Examiner*—Frederick R. Schmidt
*Assistant Examiner*—Steven P. Schad
*Attorney, Agent, or Firm*—Sommer & Sommer

[57] ABSTRACT

Apparatus for pushing or pulling a cylindrical object includes a frame, a carriage slidably mounted on the frame, and a hydraulic actuator. An intermediately-pivoted lever is mounted on the carriage. The lower end of this lever is connected to the actuator. A roller member is mounted on the upper end of the lever for movement toward and away from a jaw member on the carriage. A stop member may be selectively located on the carriage to limit angular movement of the lever, thereby to allow relative movement between the jaw and the object in one direction but not in the other.

13 Claims, 9 Drawing Figures

APPARATUS FOR MOVING A CYLINDRICAL OBJECT

BACKGROUND OF THE INVENTION

This is a continuation of application Ser. No. 380,137 filed on May 20, 1982, and now abandoned.

FIELD OF THE INVENTION

The present invention relates generally to apparatus for moving a cylindrical object, and more particularly to the field of pipe pullers-pushers.

DESCRIPTION OF THE PRIOR ART

Pipe pullers-pushers are, of course, known, and examples thereof are shown in one or more of the following U.S. Pat. Nos.: 1,427,669; 1,698,498; 2,056,489; 2,612,343; 3,882,001; 2,950,085; 3,645,502; 3,966,169; 3,945,608; 3,988,003; 3,988,004; and 4,000,879.

In many of these patents, the means for gripping the pipe has included a pair of parallel, spring-biased plates provided with aligned openings through which the pipe passed. Such plates would permit movement relative to the pipe in one direction, but not in the opposite direction. Such pivot plates have a tendency to dig into the outer surface of the pipe, as shown in FIG. 7 of U.S. Pat. No. 4,000,879, with the effect of marring and scarring such outer surface. This problem can become acute when such pipe is intended for repeated reuse.

The principal problem faced by applicant was to design an improved pipe puller-pusher which would permit such unidirectional ratchet-like gripping of the pipe, without unduly marring its outer surface.

SUMMARY OF THE INVENTION

The present invention provides an improvement in apparatus for moving a cylindrical object, such as a pipe and the like, along its axis of elongation. Such apparatus has a frame, a carriage mounted on the frame for reciprocating movement therealong, and an actuator mounted on the frame. The improvement broadly includes at least one jaw member mounted on the carriage for movement therewith; an intermediately-pivoted lever mounted on the carriage, the lever having one marginal end portion engaged by the actuator and having its other marginal end portion arranged in spaced relation to the jaw member; the lever being movable in one angular direction to cause the lever other marginal end portion to move toward the jaw member to capture the object therebetween, and movable in the opposite angular direction to cause the lever other marginal end portion to move away from the jaw member so as to release the object; and a stop member mounted on the carriage for limiting the extent of angular movement of the lever in such opposite direction.

Accordingly, the general object of the present invention is to provide improved apparatus for moving an object along its axis of elongation.

Another object is to provide such apparatus with an improved gripping means, whereby the likelihood that the outer surface of such object will be marred or scarred, will be reduced.

Another object is to provide such apparatus having improved means for selectively gripping the object to be moved.

Still another object is to provide a unique pipe pusher-puller, which is compact, easy to use, and has improved mechanism for selectively gripping the object without unduly marring or scarring the same.

These and other objects and advantages will become apparent from the foregoing and ongoing specification, the drawings, and the appended claims.

DESCRIPTION OF THE PREFERRED EMBODIMENTS

Figure 1:
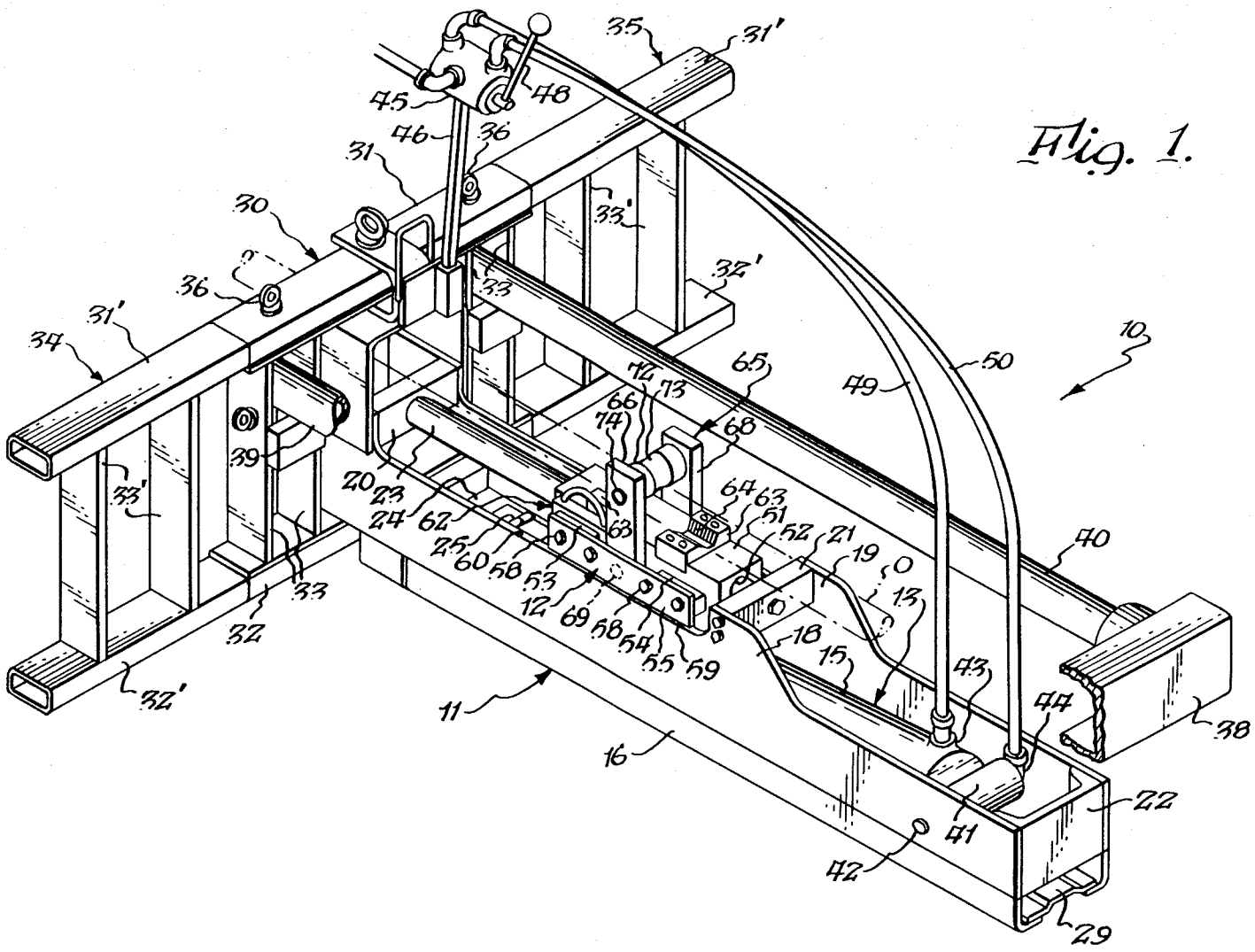
FIG. 1 is an isometric view looking at the left rear of the apparatus.

At the outset, it should be clearly understood that like reference numerals are intended to identify the same elements and/or structure consistently throughout the several drawing figures, as such elements and/or structure may be further described or explained by the entire written specification of which this detailed description is an integral part.

Referring now to the drawings, and more particularly to FIG. 1 thereof, the improvement provides improved apparatus, of which a presently-preferred embodiment is generally indicated at 10, for moving an elongated cylindrical object along its longitudinal axis. Such cylindrical objects may include, but are not limited to, various types of rods, shafts, tube, pipes, casings and the like, whether a separate element or an integral part of some other structure. While the preferred embodiments are disclosed as being pusher-pullers for moving a pipe horizontally, this orientation of the object is not deemed critical and may be readily varied depending upon the particular object to be moved, and its actual or desired orientation. Thus, the pipe puller-pusher application is exemplary only, and the appended claims should not be limited to this particular end use.

In FIG. 1, the improved apparatus 10 is shown as broadly including a horizontally-elongated frame 11, a carriage 12 mounted on the frame for reciprocating movement therealong, and a hydraulic actuator 13 having a selectively extensible and retractable rod 14 (FIG. 4), telescopingly received in a cylindrical housing 15.

Frame 11

Figure 4:
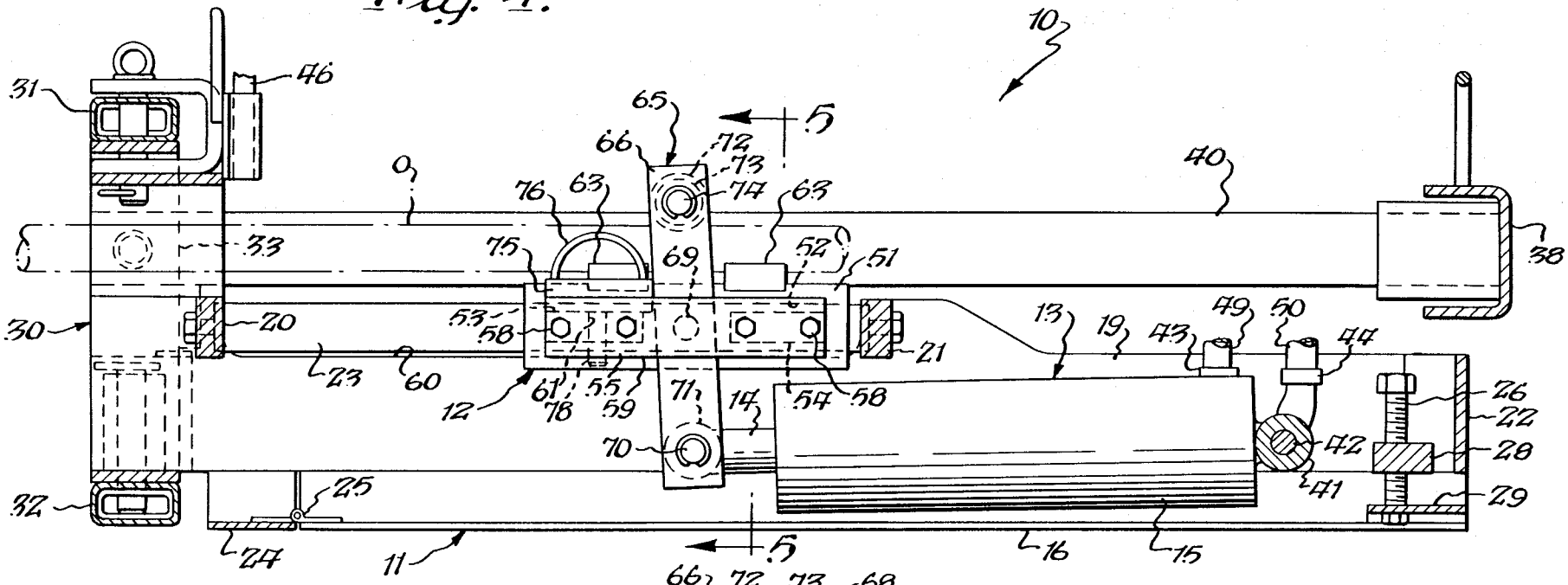
FIG. 4 is an enlarged longitudinal vertical sectional view thereof, taken generally on line 4—4 of FIG. 2.

Referring now to FIGS. 1–4, frame 11 is shown as being an assemblage of specially-configured parts suitably joined together. The frame includes a lower part 16 having a substantially U-shaped transverse cross-section, and an upper part which includes transversely-spaced longitudinally-extending parallel left and right side members 18, 19. These two side members are suitably connected together by front, middle and rear spacer blocks 20, 21 and 22, respectively. A rod 23, preferably chrome-plated and polished, is mounted on spacer blocks 20, 21 to guide movement of the carriage. Thus, the side members, spacer blocks and rod form the frame upper part subassembly. A bracket 24, having a U-shaped transverse cross-section similar to that of the lower frame, depends from a forward portion of the upper frame part. As best shown in FIG. 4, this bracket 24 is pivotally connected to the forward end of the frame lower part by means of interdigital leaf sections mounted on the frame parts, which sections cooperate to form a hinge 25. Thus, the frame upper part may pivot about hinge 25 relative to the frame lower part. Still referring principally to FIG. 4, a vertical bolt 26 has an intermediate portion threaded through a horizontal nut 28 secured to the frame upper part. The lower end of bolt 26 is adapted to bear against a plate 29 on the frame lower part. Thus, bolt 26 may be selectively rotated in the appropriate direction to either raise or lower the rear end of the upper frame relative to the lower frame, these two sections pivoting about hinge 25. By this structure the frame upper part may be pivotally inclined relative to the frame lower part.

The forward or front end of the frame is configured as a bearing wall, generally indicated at 30, which much resembles the studded wall of a house. Specifically, this forward bearing wall includes vertically-spaced transversely-extending horizontal cap and sill members 31, 32, connected by transversely-spaced vertical stud members, severally indicated at 33. These cap, sill and stud members form rough-framed bearing wall 30 at the forward end of the frame upper part. If the apparatus were placed in a trench and employed to pull a subterranean pipe, the operator would place a suitable sheet material, such as plywood, between the bearing wall 30 and the wall of the trench so that the reaction force exerted by the apparatus on the trench wall would be distributed over a relatively large area of contact.

To increase this contemplated area of contact, the cap and still members are preferably tubular so as to telescopingly receive insertion of the complementarily-configured ends of lateral left and right extensions 34, 35. Each extension has a somewhat II-shaped appearance, and includes a cap 31', a sill 32', and two stud members 33'. Once the cap and sill members of the extension have been inserted into the cap and sill members of the main bearing wall, one or more pins 36 may be inserted through such interfitted structure to securely hold the extensions to the main bearing wall. Since the purpose of the extensions is to increase the size of the bearing wall, in order that the reaction forces may be distributed over a still larger area, their use is entirely optional and depends upon the particular soil conditions encountered. The rear end of the frame is shown somewhat abbreviated in structure, only to expose the details normally hidden therebeneath. The invention expressly contemplates that the rear end of the frame may also have a type of bearing wall, as when the apparatus is used to push an object. Such rear bearing wall may be entirely separate from the front bearing wall, or the front bearing wall may be appropriately relocated to accommodate the alternative pushing operation, as desired.

A transverse horizontal member of the rear bearing wall is indicated at 38. The front bearing wall 30 and the rear bearing wall 38 are connected by left and right bearing pipes 39, 40, which are located on either side of but at the same elevation as, the object (shown in phantom) to be pushed or pulled, so as to avoid the creation of a couple. These bearing pipes 39, 40 are releasably connected to the front and rear bearing frames.

Actuator 15

The rear end of the actuator cylinder 15 has a transversely-extending tubular collar 41. A suitable fastener 42 slidably penetrates this collar and is secured to the left and right upper frame side members 18, 19. Thus, the rear end of the actuator cylinder is mounted on the frame upper part for pivotal movement about the transverse axis of fastener 42. The actuator may be of the common double-acting hydraulic type, and has two inlet fittings 43, 44 which communicate with the internal chambers (not shown) on either side of the piston (not shown) therewithin.

A spool valve 45 is shown as being mounted on the upper end of a support rod 46, the lower end of which is suitably connected to the front bearing wall. Valve 45 is adapted to communicate with an external source (not shown) and sump (not shown) of hydraulic pressure via suitable hoses 49, 50. The valve has a control handle 48 to control flow of fluid to and from the actuator's internal reciprocal chambers (not shown), thereby to selectively vary the extension or retraction of the actuator's rod 14.

Carriage 12

Carriage 12 is shown as including an elongated solid rectangular block 51 provided with a longitudinal through-bore 52, by which the block may be slidably mounted on guide rod 23. Thus, the carriage is slidably mounted on the rod for guided reciprocating movement therealong. If desired, one or more annular seals (not shown) may be provided between rod 23 and block 51, for the purpose of preventing contaminants from entering the annular space between the rod and the block's through-bore. Fore and aft spacer blocks 53, 54 extend transversely outwardly from each side of the block.

Figure 6:
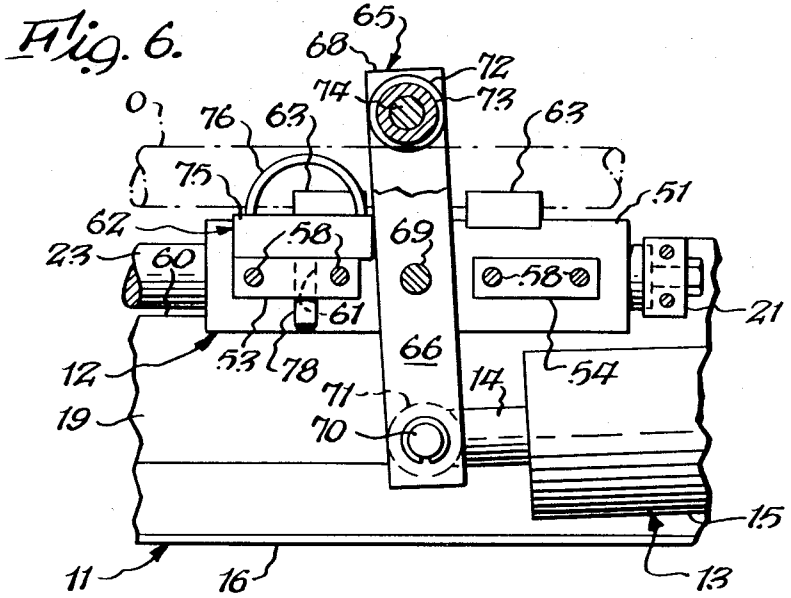
FIG. 6 is a fragmentary view of the carriage assembly showing the position of the lever when the actuator rod is retracted relative to the object.

Left and rigt side plates 55, 56 are arranged to abut the left and right spacer blocks, respectively. Each of these side plates is shown as being a horizontally-elongated vertically-disposed rectangular member affixed to the adjacent spacer blocks by means of four bolts, severally indicated at 58. In the preferred embodiment, the lowermost horizontal planar surface 59 of each side plate is arranged to slidably engage the upper horizontal planar surface 60 of the proximate frame side member. As best shown in FIG. 6, the left fore spacer block 53 and the right aft spacer block 54 are each provided with a vertical through hole, severally indicated at 61, to accommodate the pin of a manually relocatable stop member, generally indicated at 62. While these holes 61 are shown as being provided on diametrically-opposite spacer blocks, this arrangement need not invariably obtain. If desired, such holes (or some other means) may be provided on the face and aft spacer blocks in the same side, or elsewhere. While such change or modification is expressly contemplated by the invention, the details thereof are considered to be well within the ambit of a person skilled in the art. In the manner, the carriage is slidably mounted on the frame, with rod 23 penetrating through-bore 52 and with the left and right carriage side plates resting on the frame left and right side members.

Figure 2:
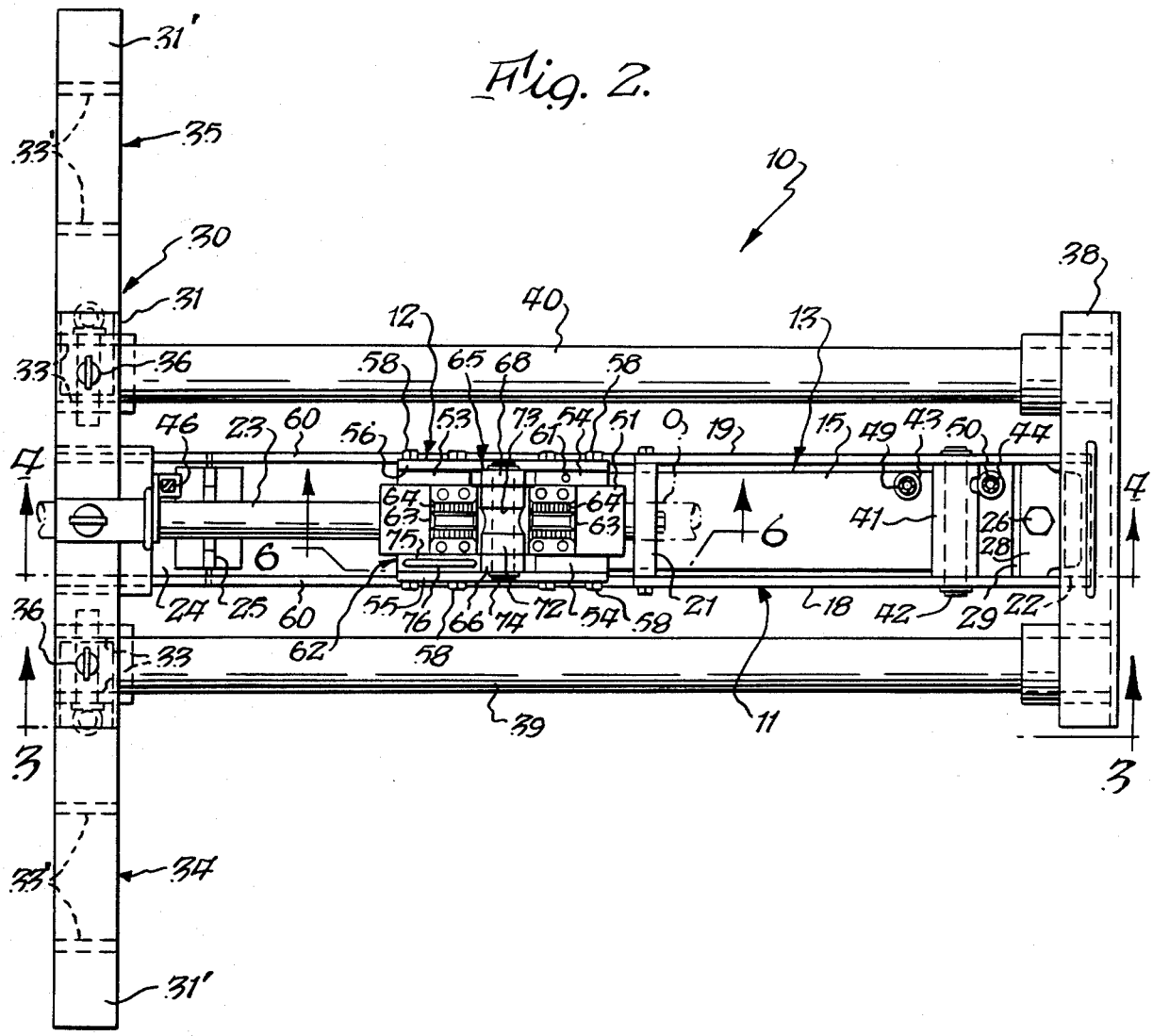
FIG. 2 is a top plan view of the apparatus shown in FIG. 1, but with the control mechanism removed for clarity of illustration.
Figure 3:
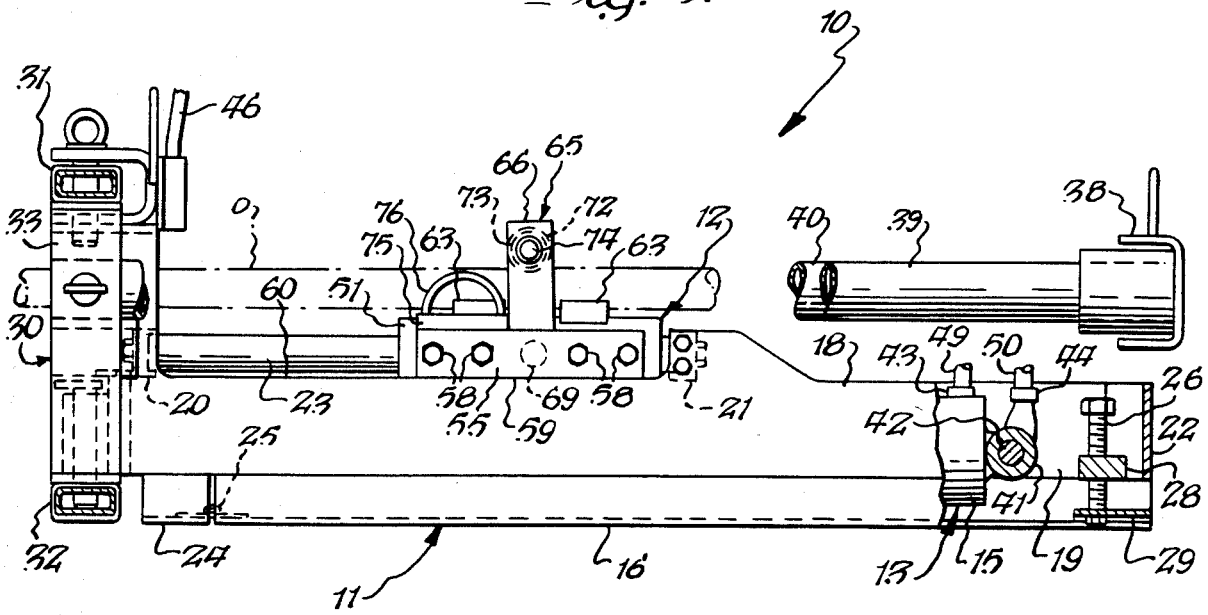
FIG. 3 is a reduced longitudinal vertical sectional view thereof, taken generally on line 3—3 of FIG. 2, showing the major parts of the frame but having selective portions thereof broken away to illustrate otherwise obscured structure.
Figure 5:
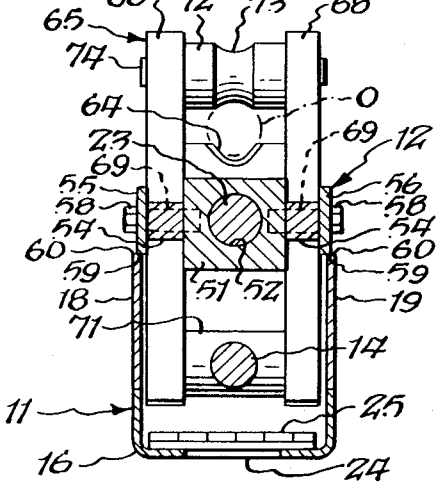
FIG. 5 is a fragmentary transverse vertical sectional view thereof, taken generally on line 5—5 of FIG. 4.

The carriage is also shown as including fore and aft jaw members, severally indicated at 63. These jaw members are spaced longitudinally from one another, with each being mounted on the horizontal upper surface of carriage block 51, ahead of and behind the lever. As best shown in FIGS. 2 and 5, each jaw member 63 is a solid member having an upwardly-facing somewhat U-shaped concave surface, suitably knurled as indicated at 64, to increase its frictional engagement with the object to be moved. This concave shape, in addition to being generally complementary to that of the object 0, also functions to center the object transversely on the carriage.

Improvement

The improvement includes an intermediately-pivoted lever, generally indicated at 65, mounted on the carriage. This lever is shown as including left and right sections 66, 68, pivotally mounted via pins 69, on the left and right sides of the carriage block 51, respectively. The lower marginal end portions of these parallel lever sections are connected by a transverse pin 70 suitably embraced by a collar 71 mounted on the distal end of actuator rod 14. Thus, these two lever sections are constrained to move together about the common pivotal axis of pins 69, 69. A freely-rotatable roller member 72, preferably having a transversely-centered concave annular recess 73, is journalled on a pin 74 connecting the upper marginal end portions of the lever sections 66, 68. Thus, as the actuator rod 14 extends (i.e., moves forwardly), the lever moves angularly in a clockwise direction (FIG. 4) with its upper roller member 72 moving toward the aft jaw member. Conversely, when the actuator rod retracts (i.e., moves rearwardly), the lever will move angularly in a counter-clockwise direction (as seen in FIG. 4) with the roller member moving toward the fore jaw member.

Figure 8:
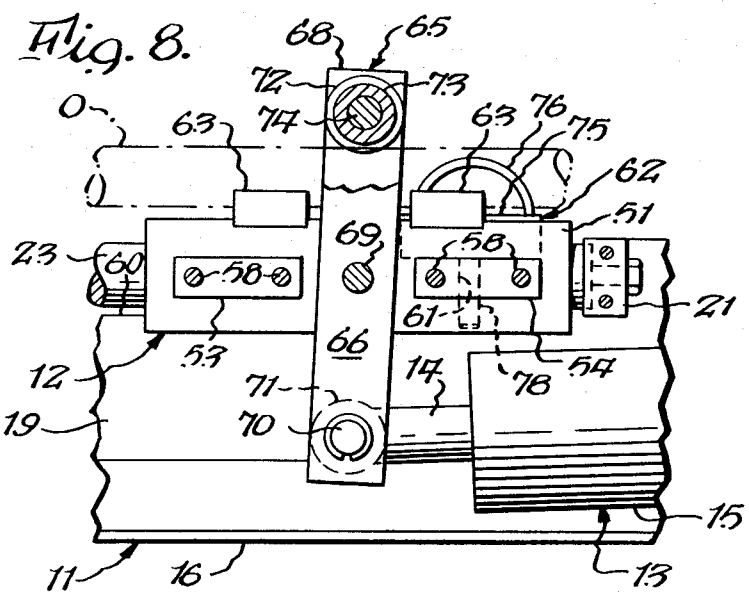
FIG. 8 is a fragmentary view of the carriage assembly showing the stop member as having been relocated on the carriage, and showing the position of the lever when the actuator rod is extended relative to the object.
Figure 9:
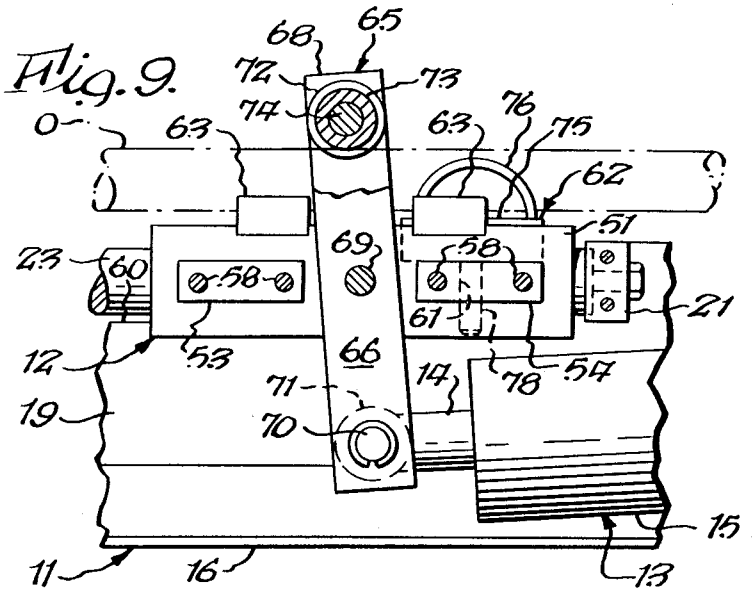
FIG. 9 is a view similar to FIG. 8 but showing the position of the lever when the actuator rod is retracted to pull the object.
Figure 7:
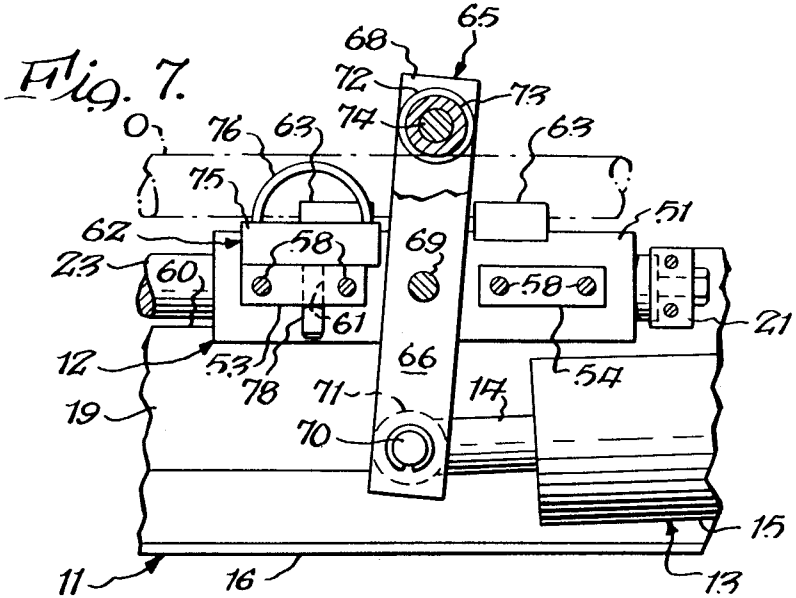
FIG. 7 is a view similar to FIG. 6, but showing the position of the lever when the actuator rod is extended to push the object.

The stop member 62 is selectively locatable on the carriage to provide a limit to such angular movement of the lever in either angular direction. The stop member itself includes a rectangular block 75 having an upper arcuate handle portion 76 and having a vertical pin 78 depending from its horizontal bottom surface. Pin 78 is adapted to be received in either of spacer block locating holes 61, 61. Thus, when the stop member 62 is in its forward position (FIGS. 6 and 7), the spacer block will prevent further counter-clockwise movement of lever 65 beyond a slightly past top-dead-center position (FIG. 6) when rod 14 retracts. However, angular movement of the lever in the clockwise direction is unimpeded by stop member 62 when the actuator rod extends (FIGS. 7). Conversely, when the stop member is in its aft position (FIGS. 8 and 9), the stop member will prevent further clockwise movement of the lever beyond a slightly past top-dead-center position (FIG. 8) when the actuator rod extends, but counter-clockwise movement of the lever will be unimpeded by stop member 62 when the actuator rod retracts.

Operation

To pull an object, the apparatus is suitably positioned so that a portion of the object is arranged between the jaw members and the roller member. The front bearing wall, with or without the extensions (as desired), is positioned to exert the reaction force against a proximate support, such as the wall of a trench. Thereafter, the operator manipulates the control lever 48 to alternatively extend and retract the actuator rod. As the rod extends (FIG. 8), the lever moves toward a position proximate top dead center, this releasing the grip on the object. Thus, extension of the rod releases the object and allows the carriage to move forwardly. However, when the actuator rod is caused to retract, the lever first pivots in a counter-clockwise direction to allow the roller member to bear against the object. The roller member, by virtue of its annular shape, exerts a normal force on the object substantially perpendicular to the object's longitudinal axis, which normal force continuously urges the object into tight frictional engagement with jaw members 63, 63. When the object has been held fast, continued retraction of the actuator rod will move the carriage rearwardly, thereby pulling the object.

To push an object, the stop member is relocated to its forward position (FIGS. 6 and 7) and with the apparatus arranged to bear against another surface. In this position the stop member holds the lever proximate its top-dead-center position as the actuator rod retracts. This allows rearward movement of the carriage relative to the object. (FIG. 6) However, when the actuator rod extends (FIG. 7, the lever may pivot in the clockwise direction so that roller member 72 first engages the object. Once the object has been so gripped, continued extension of the actuator rod will move both the carriage and the object forwardly.

Therefore, while the presently preferred embodiment has been shown and described, and several modifications thereof discussed, persons skilled in this art will readily appreciate that various additional changes and modifications may be made without departing from the spirit of the invention, as defined and differentiated by the following claims.

What is claimed is:

1. In apparatus for moving an elongated cylindrical object along its longitudinal axis, said apparatus having a frame, a carriage mounted on said frame for reciprocating movement therealong, and an actuator mounted on said frame, the improvement which comprises:

a first jaw member fixedly mounted on said carriage for movement therewith;

an elongated lever having one marginal end portion adjacent one distal end thereof and having another marginal end portion adjacent the other distal end thereof, said one marginal end portion being spaced vertically from said object to one side thereof and said other marginal end portion being spaced vertically from said object to the opposite side thereof, and intermediate portion of said lever between said marginal end portions being pivotally mounted directly on said carriage, said one marginal end portion being engaged by said actuator to provide the sole means for moving said carriage, said other marginal end portion being arranged in spaced relation to said first jaw member, said other marginal end portion having a concave arcuate surface, said lever being movable in one angular direction to cause said lever arcuate surface to move toward said first jaw member to grippingly capture said object therebetween, and movable in the opposite angular direction to cause said lever arcuate surface to move away from said first jaw member so as to release said cylindrical object therebetween; and a stop member mounted on said carriage for limiting the extent of pivotal movement of said lever relative to said carriage in said opposite angular direction.

2. The improvement as set forth in claim 1 wherein said one angular direction is clockwise.

3. The improvement as set forth in claim 1 wherein said one angular direction is counter-clockwise.

4. The improvement as set forth in claim 1 and further comprising:

a member mounted on said lever other marginal end portion for such selective engagement with said object, the outer surface of said member being said concave arcuate surface.

5. The improvement as set forth in claim 4 wherein, when said roller is moved to engage said object, the force exerted by said roller on said object is substantially perpendicular to the longitudinal axis of said object.

6. The improvement as set forth in claim 4 wherein said first jaw member is longitudinally spaced from said roller member when said object is captured therebetween.

7. The improvement as set forth in claim 1 wherein said first jaw member has a concave surface adapted to receive said object.

8. The improvement as set forth in claim 1 wherein said stop member may be relocated to another position on said carriage to limit the extent of movement of said lever in said one angular direction, whereby the operational sequence of said apparatus may be reversed.

9. In apparatus for moving an elongated cylindrical object along its longitudinal axis, said apparatus having a frame, a carriage mounted on said frame for reciprocating movement therealong, and an actuator mounted on said frame, the improvement which comprises:

a first jaw member mounted fast to said carriage for movement therewith;

an intermediately-pivoted lever mounted directly on said carriage for pivotal movement relative thereto, said lever having one marginal end portion adjacent one distal end thereof arranged beneath said object and engaged by said actuator and having another marginal end portion adjacent its other distal end portion arranged above said object in spaced relation to said first jaw member, said lever being movable in one angular direction to cause said lever other marginal end portion to move toward said first jaw member to grippingly capture said object therebetween, and movable in the opposite angular direction to cause said lever other marginal end portion to move away from said first jaw member so as to release said cylindrical object therebetween; and a stop member mounted on said carriage for limiting the extent of angular movement of said lever in said opposite direction.

10. The improvement as set forth in claim 9 wherein said other marginal end portion has a concave arcuate surface.

11. The improvement as set forth in claim 9 comprising:

a roller member mounted on said lever other marginal end portion for such selective engagement with said object.

12. The improvement as set forth in claim 9 wherein the engagement between said actuator and lever one marginal end portion provides the sole means for moving said carriage relative to said frame.

13. In apparatus for moving an elongated cylindrical object along its longitudinal axis, said apparatus having a frame, a carriage mounted on said frame for reciprocating movement therealong, and an actuator mounted on said frame, the improvement which comprises:

a first jaw member mounted on said carriage for movement therewith;

an intermediately-pivoted lever mounted directly on said carriage, said lever having one marginal end portion adjacent one distal end thereof engaged by said actuator and having its other marginal end portion adjacent its other distal end portion arranged in spaced relation to said first jaw member, the engagement between said actuator and said lever one marginal end portion providing the sole means for moving said carriage relative to said frame, said lever being movable in one angular direction to cause said lever other marginal end portion to move toward said first jaw member to grippingly capture said object therebetween, and movable in the opposite angular direction to cause said lever other marginal end portion to move away from said first jaw member so as to release said cylindrical object therebetween; and a stop member mounted on said carriage for limiting the extent of angular movement of said lever in said opposite direction.

* * * * *